US008840100B2

(12) United States Patent
Tanaka

(10) Patent No.: US 8,840,100 B2
(45) Date of Patent: Sep. 23, 2014

(54) PAPER SHEET PROCESSING APPARATUS AND IMAGE FORMING SYSTEM

(75) Inventor: Yu Tanaka, Yokohama (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 41 days.

(21) Appl. No.: 13/598,168

(22) Filed: Aug. 29, 2012

(65) Prior Publication Data

US 2013/0047868 A1 Feb. 28, 2013

(30) Foreign Application Priority Data

Aug. 30, 2011 (JP) ..... 2011-186662

(51) Int. Cl.
*B42C 1/12* (2006.01)
*B30B 9/30* (2006.01)
*B65B 27/08* (2006.01)

(52) U.S. Cl.
CPC ..... *B30B 9/30* (2013.01); *B30B 9/3003* (2013.01); *B65B 27/08* (2013.01); *B42C 1/12* (2013.01)
USPC ..... 270/58.08; 270/58.07

(58) Field of Classification Search
CPC ..... B65H 37/04; B65H 2301/4223; B65H 31/26; B31F 5/001; B42C 1/12; G03G 2215/00827; G03G 15/6541
USPC ..... 270/58.07, 58.08; 271/220
See application file for complete search history.

(56) References Cited

U.S. PATENT DOCUMENTS

| | | | | |
|---|---|---|---|---|
| 5,599,009 | A * | 2/1997 | Mandel et al. | 270/58.09 |
| 5,672,018 | A | 9/1997 | Yamamoto et al. | |
| 7,419,150 | B2 * | 9/2008 | Kushida et al. | 270/58.07 |
| 7,568,688 | B2 * | 8/2009 | Nomura et al. | 270/58.12 |
| 7,862,023 | B2 * | 1/2011 | Ichihashi et al. | 270/58.09 |
| 2013/0270763 | A1 * | 10/2013 | Furuhashi et al. | 270/58.08 |

FOREIGN PATENT DOCUMENTS

| | | | |
|---|---|---|---|
| JP | 08-174947 | A | 7/1996 |
| JP | 10-218479 | A | 8/1998 |
| JP | 2004-284767 | A | 10/2004 |
| JP | 2012246135 | A * | 12/2012 |

OTHER PUBLICATIONS

Japanese Office Action dated Oct. 29, 2013 (and English translation thereof) in counterpart Japanese Application No. 2011-186662.

* cited by examiner

*Primary Examiner* — Leslie A Nicholson, III
(74) *Attorney, Agent, or Firm* — Holtz Holtz Goodman & Chick PC

(57) ABSTRACT

A paper sheet processing apparatus includes a supporting unit which supports a bundle of stacked paper sheets, a binding processing unit which performs binding processing at least at two binding positions on the bundle of paper sheets, a pair of hold-down units which hold down the bundle of paper sheets, and a moving unit which moves at least one hold-down unit from among the pair so as to separate from the other hold-down unit in a direction in which the at least two binding positions are aligned in the bundle of paper sheets. In the paper sheet processing apparatus, the binding processing unit performs the binding processing between the pair of hold-down units on the bundle of the paper sheets following moving of at least one hold-down unit among the pair of hold-down units while the pair of hold-down units is holding down the bundle of the paper sheets.

8 Claims, 9 Drawing Sheets

PAPER SHEET PROCESSING APPARATUS AND IMAGE FORMING SYSTEM

BACKGROUND OF THE INVENTION

1. Field of the Invention

The present invention relates to a paper sheet processing apparatus and an image forming system.

2. Description of Related Art

Conventionally, as a post-processing apparatus for performing various types of post-processing on a plurality of paper sheets conveyed out from an image forming apparatus or the like, there is known a paper sheet processing apparatus in which a required number of paper sheets are stacked and matched and then, which performs binding processing by driving binding pins in the matched paper sheets.

In such paper sheet processing apparatus, there is provided a technique which perform an accurate biding processing by a hold-down member supporting the paper sheets which are stacked and aligned by pressing the paper sheets in their thickness direction (for example, see Japanese Laid-open Patent Application 2004-284767).

However, even when a bundle of paper sheets is held down by a hold-down member as in the above mentioned conventional paper sheet processing apparatus, there are cases where the paper sheet on the top of the bundle bulges in the thickness direction of the bundle of paper sheets. For example, when the binding pins 201 and 202 are driven in at predetermined two positions in the bundle of paper sheets SA1, respectively, in a state where the paper is bulged as shown in FIG. 9, a good appearance cannot be obtained because the bulged portion remains in the bundle of paper sheets SA1 between the binding pins 201 and 202.

SUMMARY OF THE INVENTION

In view of the above problem, an object of the present invention is to provide a paper sheet processing apparatus and an image forming system in which binding processing can be performed without generating a bulge in a bundle of paper sheets in the thickness direction.

To achieve at least one of the abovementioned objects, a paper sheet processing apparatus reflecting one aspect of the present invention includes a supporting unit which supports a bundle of stacked paper sheets, a binding processing unit which performs binding processing at least at two binding positions on the bundle of paper sheets, a pair of hold-down units which hold down the bundle of paper sheets by pressing the bundle of paper sheets against the supporting unit, a moving unit which moves at least one hold-down unit from among the pair of hold-down units so as to separate the at least one hold-down unit from the other hold-down unit in a direction in which the at least two binding positions are aligned in the bundle of paper sheets and a control unit which controls the binding processing unit, the hold-down units and the moving unit, and the control unit is configured to perform operations including stacking a plurality of paper sheets on the supporting unit to form the bundle of paper sheets, holding down the bundle of paper sheets formed on the supporting unit by the pair of hold-down units, moving, by controlling the moving unit, the at least one hold-down unit of the pair of hold-down units while the pair of hold-down units are holding down the bundle of paper sheets on the supporting unit, and performing the binding processing between the pair of the hold-down units on the bundle of paper sheets by the binding processing unit.

Preferably, the moving unit moves the pair of hold-down units so as to separate from each other in the direction in which the binding positions are aligned in the bundle of paper sheets.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
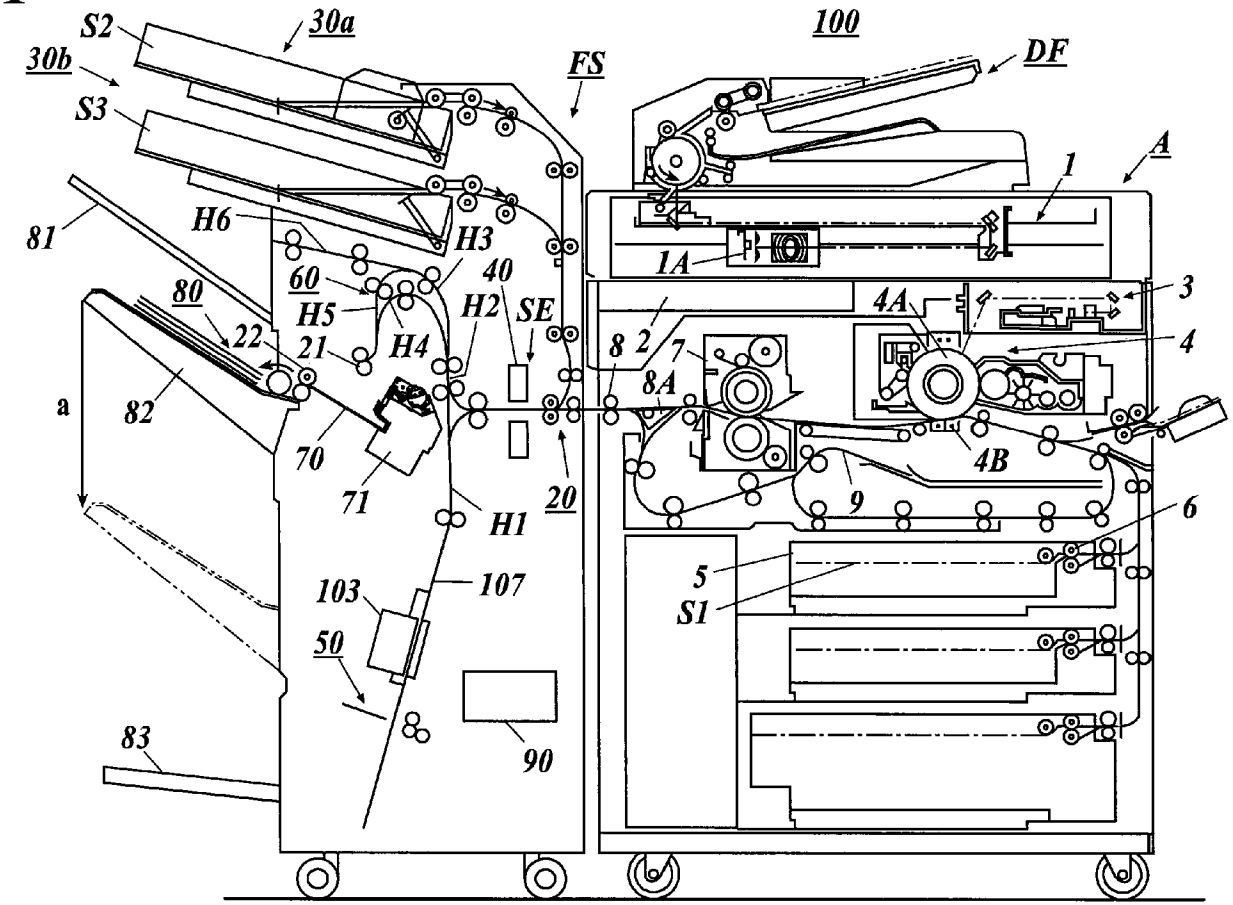
FIG. 1 is a schematic view showing an image forming system according to the present invention.

Hereinafter, an embodiment of the present invention will be described with reference to the drawings. However, although various types of technically preferred limitations for executing the present invention are shown in the following embodiment, the scope of the invention is not limited to the following embodiment and the examples shown in the drawings.

<Image Forming System>

The image forming system 100 according to the embodiment of the present invention includes an image forming apparatus A and a post-processing apparatus FS as a paper sheet processing apparatus.

<Image Forming Apparatus>

The image forming apparatus A is provided with an image reading unit 1, an image processing unit 2, an image writing unit 3, an image forming unit 4, a paper feeder cassette 5, a paper feeder 6, a fixing unit 7, a paper ejection unit 8, an automatic double-side copying sheet feeder (ADU) 9 and the like.

An automatic document feeder DF is mounted on the image forming apparatus A. The post-processing apparatus FS is connected to the left surface side of the image forming apparatus A in FIG. 1, that is, in the paper ejection unit 8 side of the image forming apparatus A.

The image reading unit 1 reads images on one side or both sides of a document, which is placed on the document platform of the automatic document feeder DF and fed, as optical images by a predetermined optical system, and the image reading unit 1 performs a photoelectric conversion of the read optical images by a CCD image sensor 1A.

The image processing unit 2 performs analog processing, A/D conversion, shading correction, image compressing processing and the like on analog signals which are photoelectrically converted by the CCD image sensor 1A and then transmits the image signals to the image writing unit 3.

The image writing unit 3 irradiates the photosensitive drum 4A of the image forming unit 4 with an output light of a semiconductor laser and forms an electrostatic latent image on the surface of the photosensitive drum 4A based on the obtained image signals.

The image forming unit 4 performs development processing on the electrostatic latent image formed on the photosensitive drum 4A and forms a toner image. The image forming unit 4 transfers the toner image on a recording paper sheet S1, which is fed by the feeder 6 from the paper feeder cassette 5, by the transfer unit 4B. The recording paper sheet S1 on which the toner image is transferred is conveyed to the fixing unit 7.

The fixing unit 7 performs fixing processing by applying heat and pressure on the recording paper sheet S1 on which the toner image is transferred by the image forming unit 4 and thereby forms an image on the recording paper sheet S1. The recording paper sheet S1 on which an image is formed is conveyed to the post-processing apparatus FS from the paper ejection unit 8.

When double-side copying is to be performed on a recording paper sheet S1, the recording paper sheet S1 which passed through the fixing unit 7 and in which an image is formed on one side thereof is conveyed to the automatic double-side copying sheet feeder 9 by the conveyance path switching plate 8A so that front and back of the recording paper sheet S1 is reversed. Thereafter, again, an image is to be formed on the other surface of the recording paper sheet S1 by the image forming unit 4 and the fixing unit 7. The recording paper sheet S1 on which images are formed on both sides thereof is conveyed to the post-processing apparatus FS through the paper ejection unit 8.

<Post-Processing Apparatus>

Next, the post-processing apparatus FS according to the embodiment of the present invention will be described with reference to FIG. 1.

The post-processing apparatus FS is provided with a paper entrance unit 20, insertion sheet feeders 30*a* and 30*b*, a hole-punch processing unit 40, a folding processing unit 50, a piling processing unit 60, staplers 71 and 103, a paper ejection unit 80 and the like.

The paper entrance unit 20 is provided on a side surface of the post-processing apparatus FS which faces the image forming apparatus A and is connected with the image forming apparatus A. The recording paper sheets S1 on which images are formed in the image forming apparatus A are conveyed into the paper entrance unit 20 via the paper ejection unit 8.

The insertion sheet feeder 30*a* and 30*b* are provided at the upper part of the post-processing apparatus FS, and insertion sheets S2 are filled in the insertion sheet feeder 30*a* and another insertion sheets S3 are filled in the insertion sheet feeder 30*b*. The insertion sheets S2 and S3 are insertion sheets such as cover sheets and insert paper sheets to be inserted between a plurality of recording paper sheets S1 which are ejected from the image forming apparatus A, and similarly to the recording paper sheets S1, the hole-punch processing, the folding processing and such like can be performed on the insertion sheets S2 and S3. The insertion sheets S2 and S3 which are sent out from the insertion sheet feeders 30*a* and 30*b* are conveyed to the paper entrance unit 20 through the conveyance paths that lead downward.

In the following description, the recording paper sheets S1 and the insertion sheets S2 and S3 are called the paper sheets S all together.

The hole-punch processing unit 40 is provided near the paper entrance unit 20. The hole-punch processing unit 40 creates holes in paper sheets S at predetermined positions by moving the bladed cylinders up and down by a predetermined driving mechanism.

The piling processing unit 60 is disposed at the downstream side in the conveyance direction of the conveyance path H2 which is divided to proceed upward from the paper entrance unit 20. The piling processing unit 60 is for securing some time for performing binding processing on paper sheets S by the stapler 71.

Here, the conveyance path H2 divides into the conveyance path H3 and the conveyance path H4 at the downstream side in the conveyance direction, and the conveyance path H3 is further divided into the conveyance path H5 and the conveyance H6. A conveyance roller 21 is provided at the end of the conveyance path H4 and the end of conveyance path H4 and the end of conveyance path H5 are combined at the conveyance roller 21. The piling processing unit 60 is constituted of the above conveyance paths H3 to H5 and the conveyance roller 21.

The piling processing unit 60 makes the first paper sheet S of the second bundle of paper sheets that comes after the first bundle of paper sheets which is the target for the binding processing by the stapler 71 enter the conveyance path H4, and the piling processing unit 60 makes the tip of the first paper sheet S contact the conveyance roller 21 which is not rotating and be on stand-by. Further, the piling processing unit 60 makes the second paper sheet S of the second bundle of paper sheets proceed through the conveyance path H5 and makes the tip of the second paper sheet S contact the conveyance roller 21 and be on standby. When the binding processing of the first bundle of paper sheets by the stapler 71 is finished, the piling processing unit 60 restarts the rotation of the conveyance roller 21 and matches and piles the first paper sheet S and the second paper sheet S, and then conveys the paper sheets more to the downstream side in the paper conveyance direction than the piling processing unit 60.

Tip of the paper sheet S which is conveyed by the conveyance roller 21 moves in the left direction in FIG. 1, and the paper sheet S enters the stacking unit 70 which is provided diagonally when the back end of the paper sheet S separates from the conveyance roller 21. Next, the paper sheet S entered the stacking unit 70 slides down along the slant of the stacking unit 70 in such way that the back end of the paper sheet S face downward. Then, the paper sheet S is received by the back edge of the paper sheet S abutting the stoppers 72*a* and 72*b* (see FIG. 3) provided at the lower end section of the stacking unit 70. The stoppers 72*a* and 72*b* are provided so as to be in a cross-sectional U-shape when seen from the direction parallel to the surface of the paper sheet and orthogonal to the paper conveyance direction.

Here, the stapler 71 and configurations therearound will be described with reference to FIGS. 3 to 7.

The stapler 71 performs binding processing in which binding pins are driven in the bundle of paper sheets SA at least at two binding positions (for example, at biding positions t1 and t2 shown in FIGS. 4A and 4B), the bundle of paper sheets SA being formed of a set number of paper sheets S being stacked on the stacking unit 70. Here, the direction in which the binding positions t1 and t2 are lined (the direction parallel to the surface of paper sheet and orthogonal to the paper conveyance direction) is Y direction and the paper conveyance direction is X direction. For example, the stapler 71 performs binding processing in which binding pins are driven in the two binding positions t1 and t2 having a predetermined space therebetween in the Y direction at the back end section of the bundle of paper sheets SA by the stapler 71 being moved in the Y direction by a predetermined driving motor (not shown in the drawing) (see FIG. 4B). The bundle of paper sheets SA on which the binding processing is performed by the stapler 71 is conveyed upward from the lower end section of the stacking unit 70 and ejected outside the apparatus by the paper ejection unit 80.

Figure 3:
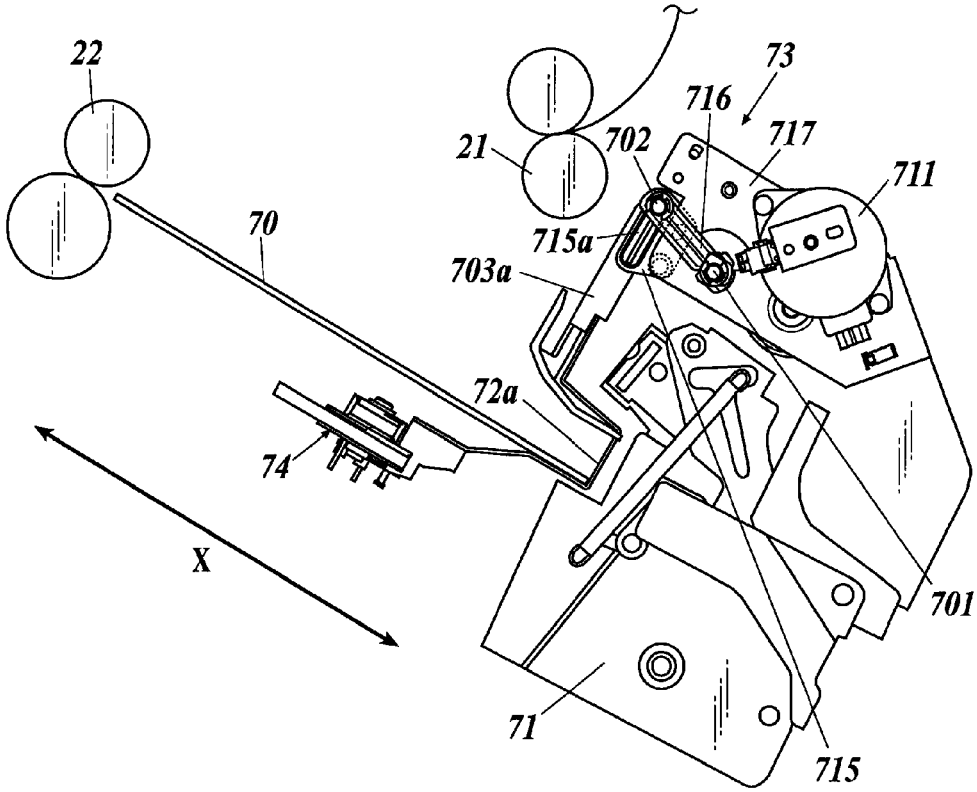
FIG. 3 is a schematic view showing a stapler and a configuration therearound.

As shown in FIG. 3, the paper hold-down mechanism 73, the moving mechanism (moving unit) 74 and such like are provided near the stapler 71 and the stoppers 72*a* and 72*b*.

The paper hold-down mechanism 73 holds down the bundle of paper sheets SA by pressing the bundle of paper sheets SA against the stoppers 72*a* and 72*b* in the thickness direction of the bundle SA, the bundle of paper sheets SA being formed of paper sheets S received by and stacked in the stoppers 72*a* and 72*b* of the stacking unit 70. The paper hold-down mechanism 73 is provided with a supporting axis 701, a driving axis 702, hold-down units 703*a* and 703*b*, a hold-down driving unit 704 and the like.

The supporting axis 701 and the driving axis 702 are provided above the stoppers 72*a* and 72*b* and they extend in the Y direction. The hold-down units 703*a* and 703*b* are attached to the driving axis 702 side by side in its axis direction so as to slide in the axis direction (Y direction). The hold-down units 703*a* and 703*b* are joined respectively to the upper end sections of the stoppers 72*a* and 72*b* and they move with the stoppers 72*a* and 72*b* along the driving axis 702 in the Y direction. Moreover, the hold-down units 703*a* and 703*b* are configured so as to move in the thickness direction of the bundle of paper sheets SA with respect to the stoppers 72*a* and 72*b*, respectively. Further, the hold-down unit 703*a* and 703*b* hold down the bundle of paper sheets SA by pressing the top surface of the bundle of paper sheets SA, which is received and supported by the stoppers 72*a* and 72*b*, to the stoppers 72*a* and 72*b* in the thickness direction of the bundle SA.

Figure 4A:
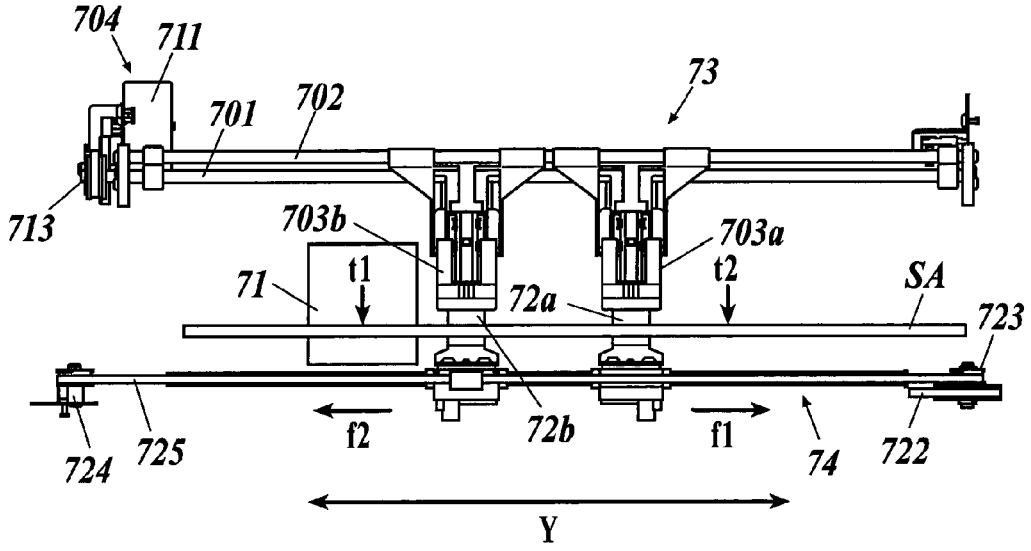
FIGS. 4A and 4B are schematic views showing a paper hold-down mechanism and a moving mechanism when seen from the paper conveyance direction.
Figure 4B:
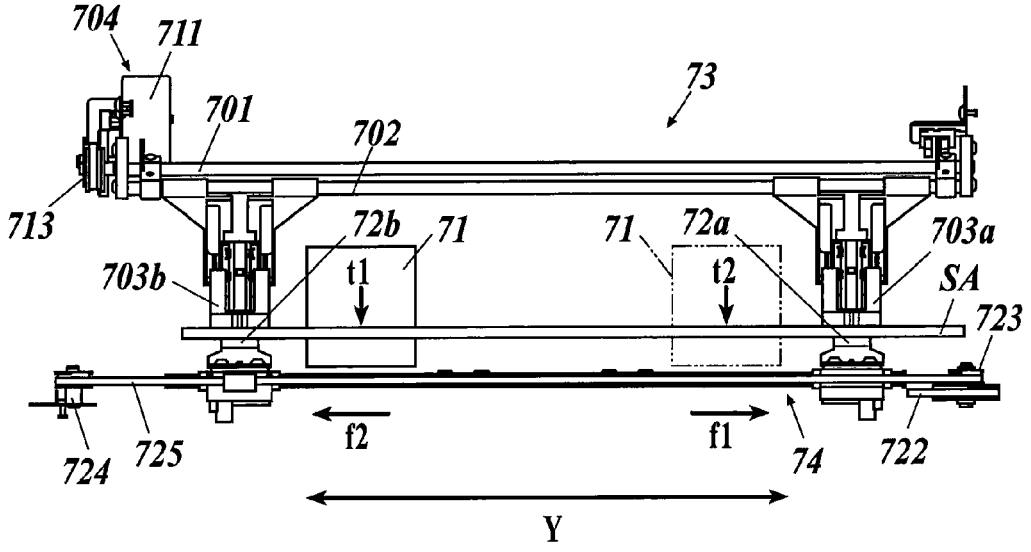
Figure 5:
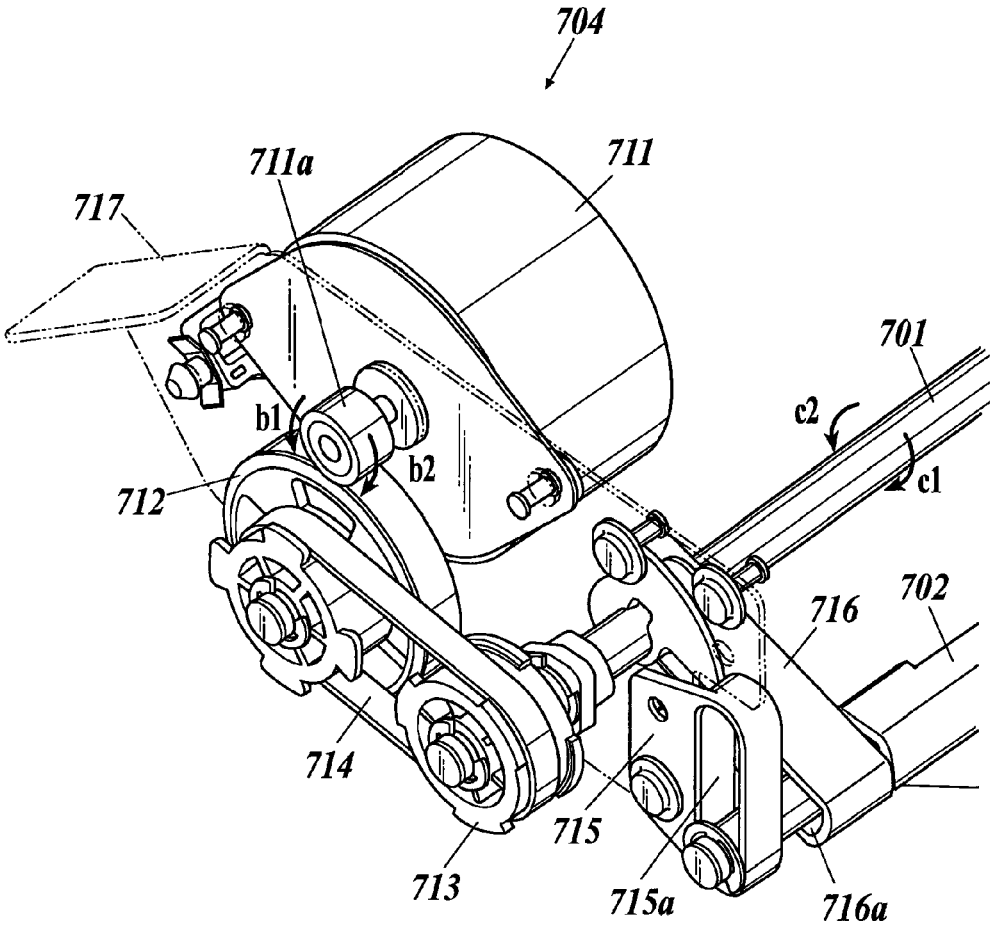
FIG. 5 is a schematic view showing a paper hold-down driving unit of the paper hold-down mechanism.
Figure 6A:
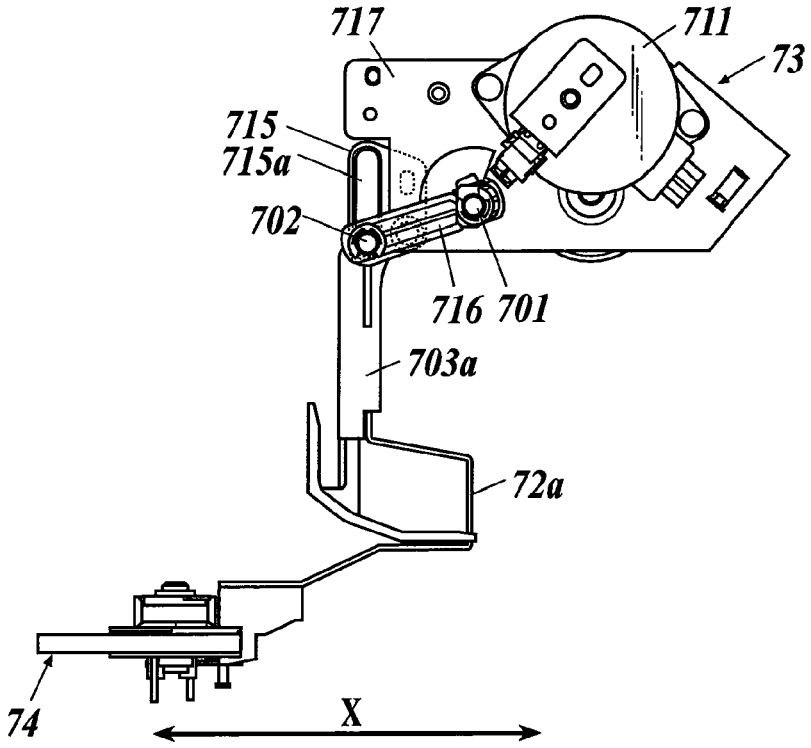
FIGS. 6A and 6B are schematic views showing the paper hold-down mechanism and the moving mechanism when seen from the direction parallel to the paper surface and orthogonal to the paper conveyance direction.
Figure 6B:
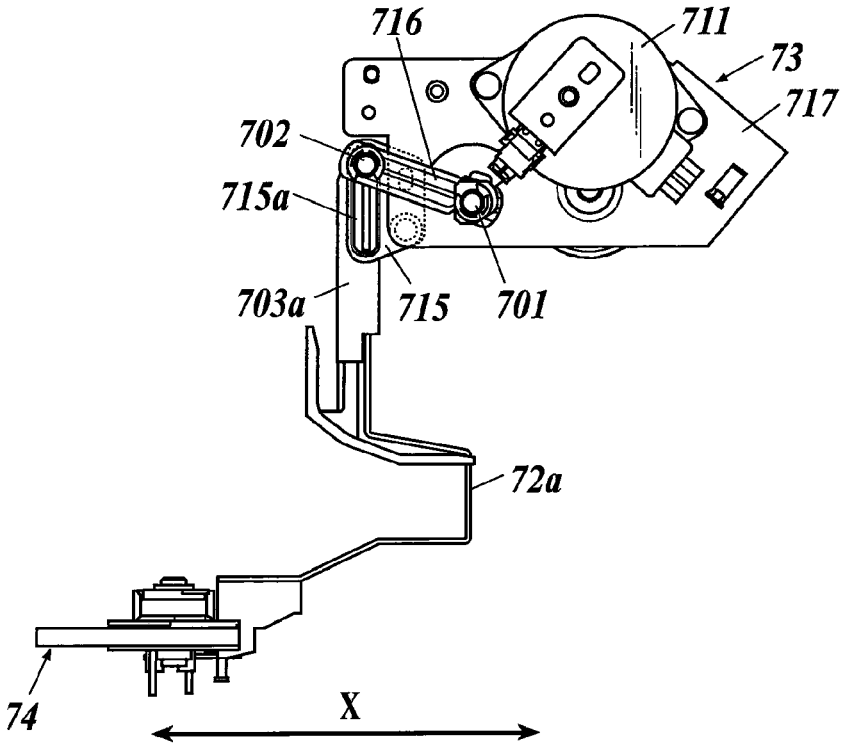
Figure 7:
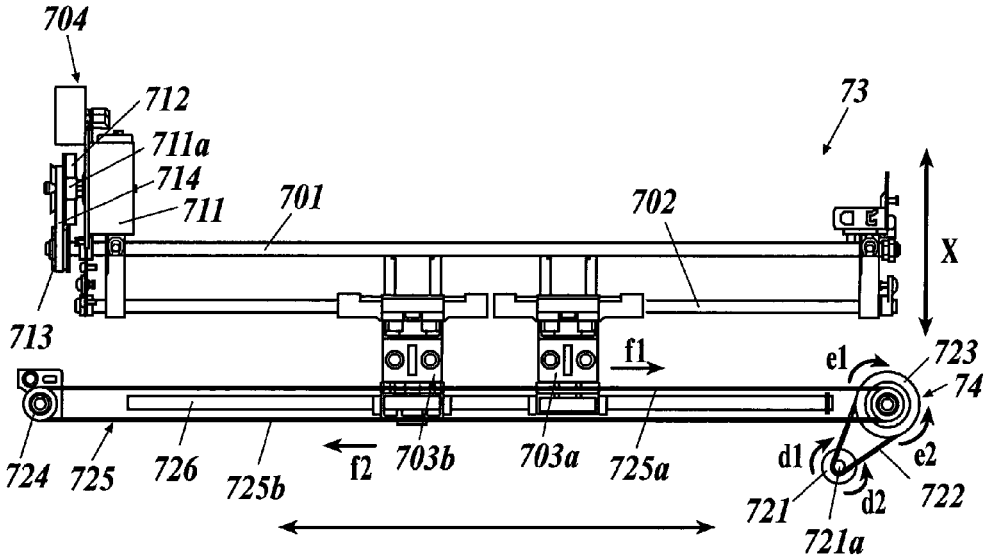
FIG. 7 is a schematic diagram showing the paper hold-down mechanism and the moving mechanism when seen from the thickness direction of the paper sheets.

As shown in FIGS. 4A and 4B and FIG. 7, the hold-down driving unit 704 is provided at one end sections of the supporting axis 701 and the driving axis 702. As shown in FIG. 5, the hold-down driving unit 704 is provided with a driving motor 711, a driven gear 712 which mesh with the driving gear 711*a* of the driving motor 711, a driven roller 713 which is fixed to one end of the supporting axis 701, a belt 714 which is crossed between the driven gear 172 and the driven roller 713, a position regulation guide 715 which regulates the moving direction of the driving axis 702 where one end of the driving axis 702 is inserted therein, a lever 716 which is provided so as to be crossed between the supporting axis 701 and the driving axis 702, a supporting plate 717 which supports the above members and the like.

One end section of the lever 716 is fixed to the supporting axis 701 and a hole 716*a* where the driving axis 702 is inserted is formed at the other end section of the lever 716. The position regulation guide 715 is provided with a hole 715*a* where the driving axis 702 is inserted, and the hole 715*a* is formed so as to extend in the thickness direction of the bundle of paper sheets SA.

According to the above configuration, by the driving motor 711 driving the driving gear 711*a* to rotate in the direction of arrow b1 in FIG. 5, the driven gear 712 and the driven roller 713 move with the rotation of the driving gear 711*a* and the supporting axis 701 which is fixed to the driven roller 713 rotates in the direction of arrow c1 in FIG. 5. By the supporting axis 701 rotating centering on its axis, the lever 716 rotates by setting one end section thereof fixed to the supporting axis 701 as the point of support and the other end section of the lever 716 moves in the direction approaching the bundle of paper sheets SA. Then, the driving axis 702 which is inserted in the hole 716*a* formed at the other end section of the lever 716 moves in the direction approaching the bundle of paper sheets SA by being guided by the hole 715*a* of the position regulation guide 715 (see FIG. 6A). In such way, the hold-down units 703*a* and 703*b* which are supported by the driving axis 702 move in the direction approaching the bundle of paper sheets SA and hold down the bundle of paper sheets SA against the stoppers 72*a* and 72*b*.

Moreover, by the driving motor 711 driving the driving gear 711*a* to rotate in the direction of arrow d2 in FIG. 5, the driven gear 712 and the driven roller 713 move with the rotation of the driving gear 711*a* and the supporting axis 701 which is fixed to the driven roller 713 rotates in the direction of arrow c2 in FIG. 5. By the supporting axis 701 rotating centering on its axis, the lever 716 rotates by setting the one end section fixed to the supporting axis 701 as the point of support and the other end section of the lever 716 moves in the direction separating from the bundle of paper sheets SA. Then, the driving axis 702 which is inserted in the hole 716*a* formed at the other end section of the lever 716 moves in the direction separating from the bundle of paper sheets SA by being guided by the hole 715*a* of the position regulation guide 715 (see FIG. 6B). In such way, the hold-down units 703*a* and 703*b*, which are supported by the driving axis 702, move in the direction separating from the bundle of paper sheets SA and releases the holding down of the bundle of paper sheets SA against the stoppers 72*a* and 72*b*.

The moving mechanism 74 is provided below the paper hold-down mechanism 73 and the stoppers 72*a* and 72*b*, and the moving mechanism 74 moves the hold-down units 703*a* and 703*b* and the stoppers 72*a* and 72*b*, which are joined respectively to the hold-down units 703*a* and 703*b*, in a state holding down the bundle of paper sheets SA in the Y direction so that the pair of hold-down unit 703*a* and stopper 72*a* and the pair of hold-down unit 703*b* and stopper 72*b* are to be apart from each other. As shown in FIG. 7, the moving mechanism 74 is provided with a guide rail 726 which is provided below the stoppers 72*a* and 72*b* so as to extend in the direction parallel to the supporting axis 701 and the driving axis 702, a driving motor 721 and a driven roller 723 which are provided at one end section side of the guide rail 726, a driving belt 722 which is crossed between the driving roller 721*a* and the driven roller 723 of the driving motor 721, a driven roller 724 which is provided at the other end section side of the guide rail 726, a moving belt 725 which is crossed between the driven roller 723 and the driven roller 724 and the like.

The stoppers 72*a* and 72*b* are attached to the guide rail 726 so as to slide in the extending direction of the guide rail 726. The driving motor 721 and the driven rollers 723 and 724 are disposed so that the rotation axis direction thereof is parallel to the thickness direction of the bundle of paper sheets SA. The moving belt 725 extends along the extending direction of the guide rail 726, and the stopper 72*a* is fixed to the belt unit 725*a* of the moving belt 725 and the stopper 72*b* is fixed to the belt unit 725*b* of the moving belt 725 as shown in FIG. 7.

Because the moving mechanism 74 is configured as described above, the driven roller 723 rotates in the direction of arrow e1 in FIG. 7 and the moving belt 725 rotates by the driving motor 721 driving the driving roller 721*a* to rotate in the direction of arrow d1 in FIG. 7. When the moving belt 725 rotates, the stopper 72*a* and the hold-down unit 703*a* which are attached to the belt unit 725*a* of the moving belt 725 move in the direction of arrow f1 in FIG. 7 and the stopper 72*b* and the hold-down unit 703*b* which are attached to the belt unit 725*b* of the moving belt 725 move in the direction of arrow f2 in FIG. 7. In such way, the moving mechanism 74 moves the hold-down units 703*a* and 703*b* to the respective edges of the bundle of paper sheets SA from the center of the bundle of paper sheets SA so as to separate from each other (see FIG. 4B).

Here, the moving mechanism 74 may move the hold-down units 703*a* and 703*b* in the Y direction from inner side of the biding positions t1 and t2 of the bundle of paper sheets SA to outside of the binding positions t1 and t2 so as to separate from each other. In such case, the moving mechanism 74 does not need to move the hold-down units 703*a* and 703*b* to the respective edges of the bundle of paper sheets SA in the Y direction, and it is sufficient that the hold-down units 703*a* and 703*b* are moved at least to respective positions more outside than the binding positions t1 and t2 (toward the edges of the bundle of paper sheets SA).

Moreover, by the driving motor 721 driving the driving roller 721*a* to rotate in the direction of arrow d2 in FIG. 7, the driven roller 723 rotates in the direction of arrow e2 in FIG. 7 and the moving belt 725 rotates. When the moving belt 725 rotates, the stopper 72*a* and the hold-down unit 703*a* which are attached to the belt unit 725*a* of the moving belt 725 move in the direction of arrow f2 in FIG. 7 and the stopper 72*b* and the hold-down unit 703*b* attached to the belt unit 725*b* of the moving belt 725 move in the direction of arrow f1 in FIG. 7. In such way, after the binding processing by the stapler 71 is finished, the moving mechanism 74 moves the hold-down units 703*a* and 703*b*, in which their holding down of the bundle of paper sheets SA is released, in the direction approaching each other from the respective end sections of the bundle of paper sheets SA to the center of the bundle of paper sheets SA and returns the hold-down units 703*a* and 703*b* to their home positions (see FIG. 4A).

The paper ejection unit 80 is disposed more at the downstream side in the conveyance direction than the piling processing unit 60 and the stapler 71, and the paper ejection unit 80 ejects the bundle of paper sheets SA outside the apparatus via the paper ejection roller 22. The paper ejection roller 22 is constituted of a pair of rollers, and the rollers are configured so as to be separated from each other at the time of non-paper ejection period and the rollers contact each other at the time of paper ejection to nip the paper sheets S. The bundle of paper sheets SA on which the binding processing is performed by the stapler 71 is conveyed to the stacking unit 70 and nipped by the paper ejection roller 22 to be further conveyed toward downstream side in the paper conveyance direction, and the bundle SA is ejected to the rising/lowering ejection plate 82. The rising/lowering ejection plate 82 is disposed outside the post-processing apparatus FS so as to project therefrom and can move upward and downward so that the top surface of the ejected bundles of paper sheets SA is always at a certain height level. For example, the rising/lowering ejection plate 82 can move in the direction of arrow a in FIG. 1 to move to the position shown in the dashed-two dotted line in FIG. 1.

The conveyance path H6 which is divided from the conveyance path H3 forms the ejection path for ejecting paper sheets S to the fixed ejection plate 81. The fixed ejection plate 81 is disposed at the downstream side of the conveyance path H6 so as to project outside from the post-processing apparatus FS. The paper sheets S which are ejected after being conveyed through the conveyance paths H2, H3 and H6 are stacked on the fixed ejection plate 81.

The folding processing unit 50 is disposed at the downstream side in the paper conveyance direction of the conveyance path H1 which is divided downward from the paper entrance unit 20. Further, an intermediate stacking tray 107, a stapler 103 and the like are disposed at the downstream side in the paper conveyance direction of the conveyance path H1. These folding processing unit 50 and stapler 103 perform middle folding processing, middle folding/middle binding processing or fold-in-three processing on the bundle of paper sheets stacked in the intermediate stacking tray 107.

Here, configuration similar to the above described paper hold-down mechanism 73 and moving mechanism 74 may be provided near the stapler 103.

Figure 2:
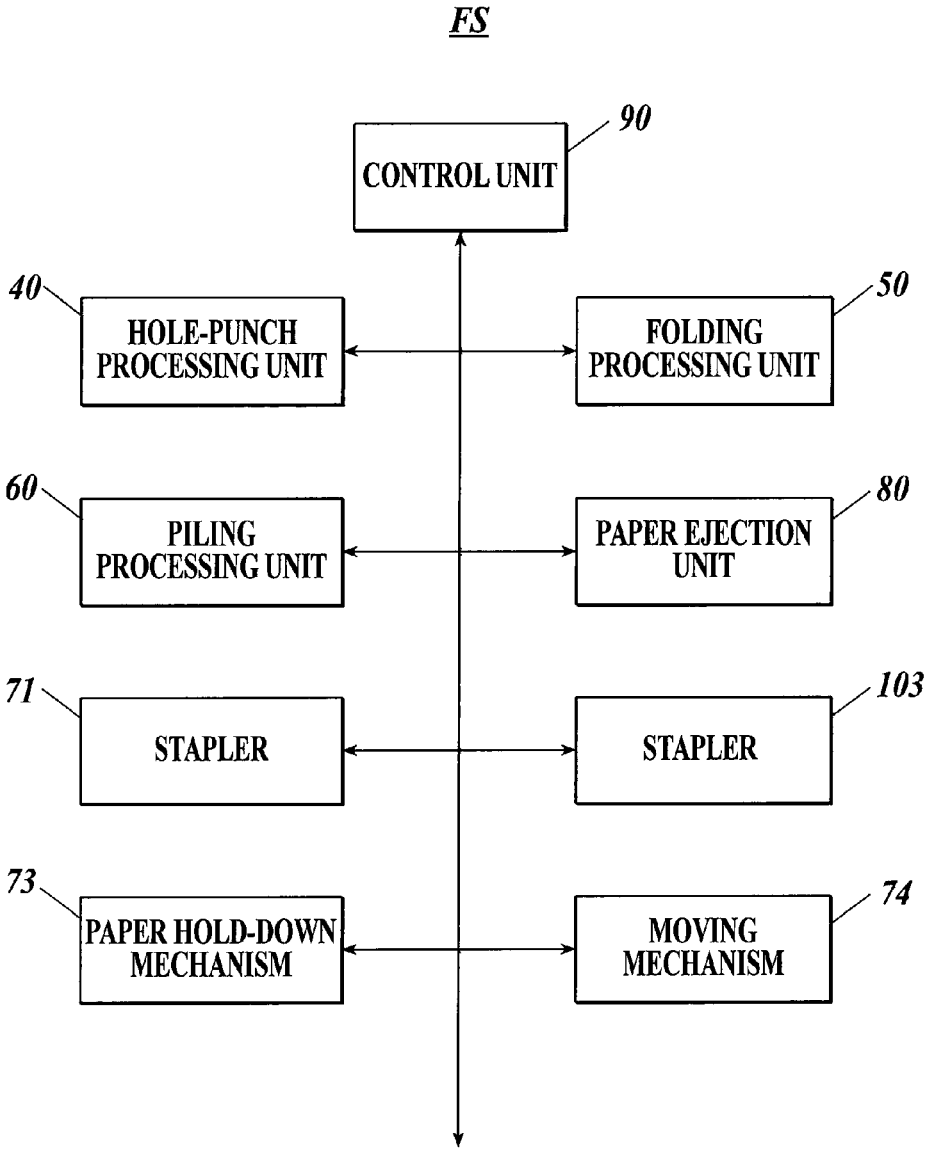
FIG. 2 is a block diagram showing a control system of a post-processing apparatus which constitutes the image forming system.

As shown in FIG. 2, the control unit 90 of the post-processing apparatus FS controls each part of the post-processing apparatus FS. The control unit 90 includes a CPU (Central Processing Unit), a RAM (Random Access Memory) and a ROM (Read Only Memory) which are not shown in the drawings. When the control unit 90 receives information related to post-processing of a bundle of paper sheets SA from the main control unit (not shown in the drawing) of the image forming apparatus A, the control unit 90 carries out various types of operations according to various types of processing programs for post-processing apparatus FS.

In the embodiment, the control unit 90 makes the hold-down units 703*a* and 703*b* hold down the bundle of paper sheets SA and makes the moving mechanism 74 move the hold-down units 703*a* and 703*b*, which are in the state holding down the bundle of paper sheets SA, so as to separate from each other in the Y direction and then, makes the stapler 71 perform the binding processing on the bundle of paper sheets SA between the hold-down units 703*a* and 703*b*.

Figure 8:
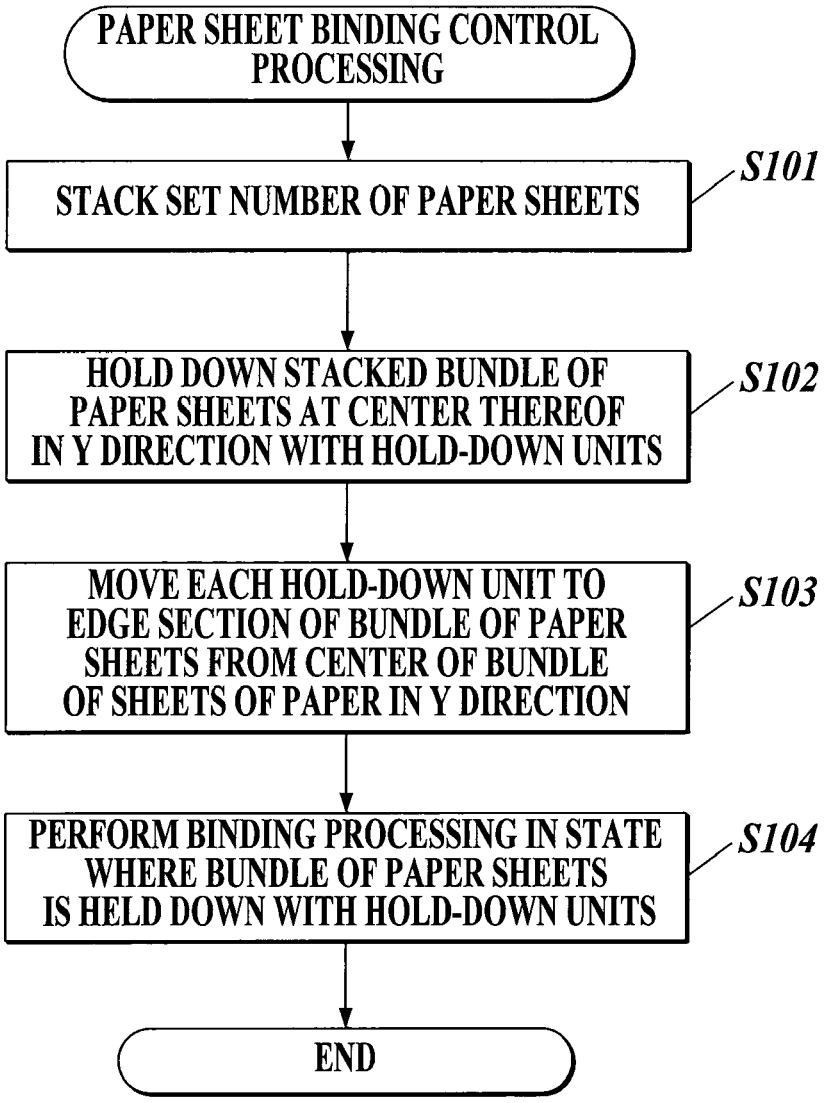
FIG. 8 is a flowchart showing an example of paper binding control processing.
Figure 9:
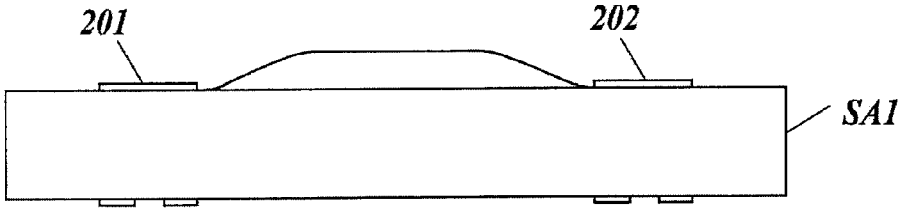
FIG.9 RELATED ART
FIG. 9 is a schematic view showing a bundle of paper sheets when binding processing is performed by a conventional apparatus.

An example of paper sheet binding control processing which is carried out by the control unit 90 in the post-processing apparatus FS which is configured as described above will be described with reference to FIG. 8. The paper sheet binding control processing described herebelow is to be carried out to bundles of paper sheets SA one bundle by one bundle, a bundle of paper sheets SA being formed by a predetermined number of paper sheets SA.

First, the control unit 90 stacks the predetermined number of paper sheets S in the stacking unit 70 (step S101). The paper sheets S which are ejected from the conveyance path H4 or H5 slide down the stacking unit 70 so that the back end section of the paper sheets S are received and supported by the stoppers 72*a* and 72*b*. In such way, the paper sheets are matched in the X direction.

Next, the control unit 90 makes the hold-down units 703*a* and 703*b* hold down the center section in the Y direction in the back end section of the bundle of paper sheets SA which is stacked in the stacking unit 70 (step S102). In particular, for example, the control unit 90 drives the driving motor 711 to drive and rotate the driving gear 711*a* in the direction of arrow b1 in FIG. 5, and thereby, rotates the driven gear 712 and the driven roller 713. In such way, the supporting axis 701 which is fixed to the driven roller 713 rotates in the direction of arrow c1 in FIG. 5, and by setting one end of the lever 716 where the lever 716 is fixed to the supporting axis 701 as the point of support, the other end of the lever 716 rotates. The driving axis 702 which is attached to the other end of the lever 716 comes down in the direction approaching the bundle of paper sheets SA by being guided by the hole 715*a* of the position regulation guide 715 (see FIG. 6A). Due to the driving axis 702 coming down, the hold-down units 703*a* and 703*b* attached to the driving axis 702 holds down the bundle of paper sheets SA.

Next, the control unit 90 makes the hold-down units 703*a* and 703*b*, which are in the condition holding down the bundle of paper sheets SA, move so as to separate from each other in the Y direction from the center section of the bundle of paper sheets SA to the respective end sections of the bundle of paper sheets SA (step S103). In particular, for example, the control unit 90 makes the driven roller 723 rotate in the direction of arrow e1 in FIG. 7 to rotate the moving belt 725 which is crossed between the driven rollers 723 and 724 by driving the driving motor 721 to drive and rotate the driving roller 721*a* in the direction of arrow d1 in FIG. 7. Because the stoppers 72*a* and 72*b* are attached to the moving belt 725 and the hold-down units 703*a* and 703*b* are attached respectively to the stoppers 72*a* and 72*b*, the control unit 90 makes the moving belt 725 rotate to move the hold-down unit 703*a* in the direction of arrow f1 in FIG. 7 and to move the hold-down unit 703*b* in the direction of arrow f2 in FIG. 7 (see FIG. 4B).

Because the control unit 90 makes the moving mechanism 74 move the hold-down units 703*a* and 703*b*, which are in the state holding down the top surface of the bundle of paper sheets SA, in the Y direction, the paper sheet S which is stacked at the top of the bundle of paper sheets SA is pulled in the Y direction and the holding down of the bundle of paper sheets SA is maintained while the sheet of paper S being pulled.

Finally, the control unit 90 makes the stapler 71 perform binding processing on the bundle of paper sheets SA in its back end section at the binding positions t1 and t2 by having a space between the binding positions in the Y direction, the bundle of paper sheets SA being held down with the hold-down units 703*a* and 703*b* (step S104). In such way, the binding processing can be performed on the bundle of paper sheets SA in a state where the paper sheet S which is stacked at the top of the bundle of paper sheets SA being pulled in the Y direction. Thus, bulging of the bundle of paper sheets SA in its thickness direction can be suppressed.

Moreover, after the binding processing is performed by the stapler 71, the control unit 90 makes the hold-down units 702*a* and 703*b* release the held down state of the bundle of paper sheets and makes the hold-down units 703*a* and 703*b* return to their home positions by the moving mechanism 74 (see FIG. 4B).

Here, the paper sheet binding control processing is finished.

As described above, according to the embodiment, the bundle of paper sheets SA is held down with a pair of hold-down units 703*a* and 703*b*, and the binding processing is performed between the hold-down units 703*a* and 703*b* which are holding down the bundle of paper sheets SA by the stapler 71 after the hold-down units 703*a* and 703*b*, which are in the state holding down the bundle of paper sheets SA, are moved from the center of the bundle to respective end sections of the bundle in the direction in which the binding positions t1 and t2 are aligned. Therefore, the paper sheet S stacked at the top of the bundle of paper sheets SA is pulled in the direction in which binding positions t1 and t2 are aligned and the bundle of paper sheets SA can be held down in its thickness direction in the state where the paper sheet S is pulled. Thereby, the bulging can be prevented from being generated in the bundle of paper sheets SA in its thickness direction, and the binding processing can be carried out without causing bulging in the bundle of paper sheets SA.

Moreover, because the hold-down units 703*a* and 703*b* are moved in the direction in which binding positions t1 and t2 are aligned so as to separate from each other, the time period needed for moving the hold-down units 703*a* and 703*b* for a predetermined distance can be shortened. Thus, the time period needed for performing the binding processing on the bundle of paper sheets SA can be shortened.

Further, because the hold-down units 703*a* and 703*b* are moved to the respective edge sections of the bundle of paper sheets SA from the center of the bundle of paper sheets SA in the direction in which binding positions t1 and t2 are aligned, the paper sheet S which is stacked at the top of the bundle of paper sheets SA is pulled in the above direction as a whole. Therefore, the bulging can be prevented from being generated in the bundle of paper sheets SA in its thickness direction more surely. Further, because the paper sheet S which is stacked at the top of the bundle of paper sheets SA is pulled in the direction in which binding positions t1 and t2 are aligned as a whole, bulging can be prevented from being generated in the thickness direction of the bundle of paper sheets SA even when the binding processing is to be performed at any position in the bundle of paper sheets S in the direction in which binding positions t1 and t2 are aligned.

When the hold-down units 703*a* and 703*b* are to be moved to outside of the binding positions t1 and t2 from inside thereof in the direction in which binding positions t1 and t2 are aligned, the area around the binding positions t1 and t2 in the paper sheet S which is stacked at the top of the bundle of paper sheets SA can be pulled in the direction in which binding positions t1 and t2 are aligned. Therefore, the paper sheet S can be pulled for sure.

Here, in the embodiment, the stapler performs binding processing at two binding positions in the bundle of paper sheets. However, binding processing may be performed at three or more binding positions in the bundle of paper sheets along a predetermined direction.

Further, in the embodiment, it is configured that the hold-down units directly contact the bundle of paper sheets and hold down the bundle of paper sheets by pressing the hold-down units against the stoppers. However, the configuration can be such that each of the hold-down units is provided with a roller at the part where contact with the bundle of paper sheets and the bundle of paper sheets is held down by the hold-down units via the rollers. It is sufficient that such rollers are configured so as to rotate freely with respect to the direction the hold-down units are moved by the moving mechanism. Thereby, even when the hold-down units firmly hold down the bundle of paper sheets, the paper sheet which is stacked at the top of the bundle of paper sheets can be prevented from being damaged due to moving of the hold-down units.

Moreover, in the embodiment, the hold-down units and the stoppers are moved by the moving mechanism. However, the configuration may be that only hold-down units are moved by the moving mechanism.

Further, in the embodiment, the moving mechanism moves a pair of hold-down units so that the hold-down units are moved in the directions separating from each other in the direction parallel to the paper sheet surface and orthogonal to the paper conveyance direction. However, the moving directions with respect to the paper sheets does not need to be the above described directions as long as the hold-down units move in the direction in which the binding positions of staplers align. For example, when the stapler performs the binding processing at the binding positions along the paper conveyance direction, the moving mechanism moves the pair of hold-down units so that the hold-down units are moved in the directions separating from each other in the paper conveyance direction.

Furthermore, in the embodiment, the moving mechanism moves the pair of hold-down units so that the hold-down units are moved in the directions separating from each other. However, one hold-down unit in the pair of hold-down units may be fixed to a predetermined position and only the other hold-down unit of the pair of hold-down units may be moved so as to separate from the hold-down unit which is fixed. In such case, if one of the hold-down units is fixed to one end section of the bundle of paper sheets and the other hold-down unit is moved toward the other end section of the bundle of paper sheets, the entire bundle of paper sheets is pulled in the moving direction. Therefore, the bulging of the bundle of paper sheets in its width direction can be suppressed more surely.

In the embodiment, one pair of hold-down units is provided. However, a plurality of pairs of hold-down units may be provided.

The entire disclosure of Japanese Patent Application No. 2011-186662 filed on Aug. 30, 2011 including description, claims, drawings and abstract are incorporated herein by reference in its entirety.

What is claimed is:

1. A paper sheet processing apparatus, comprising:

a supporting unit which supports a bundle of stacked paper sheets;

a binding processing unit which performs binding processing at least at two binding positions on the bundle of paper sheets;

a pair of hold-down units which hold down the bundle of paper sheets by pressing the bundle of paper sheets against the supporting unit;

a moving unit which moves at least one hold-down unit from among the pair of hold-down units so as to separate said at least one hold-down unit from the other hold-down unit in a direction in which the at least two binding positions are aligned in the bundle of paper sheets; and a control unit which controls the binding processing unit, the pair of hold-down units and the moving unit, wherein the control unit is configured to perform operations comprising:

stacking a plurality of paper sheets on the supporting unit to form the bundle of paper sheets;

holding down the bundle of paper sheets formed on the supporting unit by the pair of hold-down units;

moving, by controlling the moving unit, said at least one hold-down unit of the pair of hold-down units while the pair of hold-down units are holding down the bundle of paper sheets on the supporting unit; and performing the binding processing between the pair of the hold-down units on the bundle of paper sheets by the binding processing unit.

2. The paper sheet processing apparatus of claim 1, wherein the moving unit moves both of the pair of hold-down units so as to separate from each other in the direction in which the at least two binding positions are aligned in the bundle of paper sheets.

3. The paper sheet processing apparatus of claim 2, wherein the moving unit moves both of the pair of hold-down units to respective edge sections from a center section of the bundle of paper sheets so as to separate the pair of hold-down units from each other in the direction in which the at least two binding positions are aligned.

4. The paper sheet processing apparatus of claim 2, wherein the moving unit moves both of the pair of hold-down units to outside of the at least two binding positions from inside of the at least two binding positions so as to separate the pair of hold-down units from each other in the direction in which the at least two binding positions are aligned.

5. An image forming system, comprising:

an image forming apparatus which forms an image on a paper sheet; and a paper sheet processing apparatus which comprises:

a supporting unit which supports a bundle of stacked paper sheets, a binding processing unit which performs binding processing at least at two binding positions on the bundle of paper sheets, a pair of hold-down units which hold down the bundle of paper sheets by pressing the bundle of paper sheets against the supporting unit, a moving unit which moves at least one hold-down unit from among the pair of hold-down units so as to separate said at least one hold-down unit from the other hold-down unit in a direction in which the at least two binding positions are aligned in the bundle of paper sheets, and a control unit which controls the binding processing unit, the pair of hold-down units and the moving unit, wherein the control unit is configured to perform operations comprising:

stacking a plurality of paper sheets on the supporting unit to form the bundle of paper sheets;

holding down the bundle of paper sheets formed on the supporting unit by the pair of hold-down units;

moving, by controlling the moving unit, said at least one hold-down unit of the pair of hold-down units while the pair of hold-down units are holding down the bundle of paper sheets on the supporting unit; and performing the binding processing between the pair of the hold-down units on the bundle of paper sheets by the binding processing unit, wherein the paper sheet processing apparatus performs the binding processing on the bundle of the stacked paper sheets on each of which an image is formed by the image forming apparatus.

6. The image forming system of claim 5, wherein the moving unit moves both of the pair of hold-down units so as to separate from each other in the direction in which the at least two binding positions are aligned in the bundle of paper sheets.

7. The image forming system of claim 6, wherein the moving unit moves both of the pair of hold-down units to respective edge sections from a center section of the bundle of paper sheets so as to separate the pair of hold-down units from each other in the direction in which the at least two binding positions are aligned.

8. The image forming system of claim 6, wherein the moving unit moves both of the pair of hold-down units to outside of the at least two binding positions from inside of the at least two binding positions so as to separate the pair of hold-down units from each other in the direction in which the at least two binding positions are aligned.

* * * * *